US009805739B2

(12) United States Patent
Nongpiur et al.

(10) Patent No.: US 9,805,739 B2
(45) Date of Patent: Oct. 31, 2017

(54) SOUND EVENT DETECTION

(71) Applicant: Google Inc., Mountain View, CA (US)

(72) Inventors: Rajeev Conrad Nongpiur, Palo Alto, CA (US); Michael Dixon, Sunnyvale, CA (US)

(73) Assignee: Google Inc., Mountain View, CA (US)

( * ) Notice: Subject to any disclaimer, the term of this patent is extended or adjusted under 35 U.S.C. 154(b) by 27 days.

(21) Appl. No.: 14/713,619

(22) Filed: May 15, 2015

(65) Prior Publication Data

US 2016/0335488 A1 Nov. 17, 2016

(51) Int. Cl.

| | |
|---|---|
| ***H04R 29/00*** | (2006.01) |
| ***G10L 25/51*** | (2013.01) |
| ***G10L 25/18*** | (2013.01) |
| *G08B 13/16* | (2006.01) |

(52) U.S. Cl.

CPC ..... *G10L 25/51* (2013.01); *G10L 25/18* (2013.01); *G08B 13/1672* (2013.01)

(58) Field of Classification Search

CPC .. H04R 1/1041; H04R 1/1091; H04R 1/1033; H04R 1/06; H04R 1/1016; H04R 1/1075; H04R 1/10; H04R 1/1008; H04R 2420/07; H04R 2420/03; H04R 2420/05; H04R 3/00; H04R 5/033; H04R 5/0335; H04R 2201/107; H04R 2201/109; H04R 2430/01; H04R 3/04; H04R 3/005; H04R 3/02; H04R 29/00; H04R 29/005; H04R 2430/03; H04R 2430/20; H04R 2430/21; H04R 1/406; H04R 1/1083; H04R 1/04; H04R 1/32; H04R 2410/00; H04R 2410/01; H04M 1/6058; H04M 1/6066; H04M 1/05; H04M 2250/12; H03G 3/32; H03G 5/005; H03G 5/165; H03G 5/025; H03G 9/025; H03G 3/001; H04S 7/302; H04S 1/00; H04S 3/00; H04S 7/307; H04S 7/301; H04S 7/40; H04S 7/00; H04S 7/305; A01K 29/00; A01K 29/005; A01K 11/008;

(Continued)

(56) References Cited

U.S. PATENT DOCUMENTS

| | | |
|---|---|---|
| 7,262,690 B2 | 8/2007 | Heaton et al. |
| 7,659,814 B2 | 2/2010 | Chen et al. |

(Continued)

*Primary Examiner* — Leshui Zhang

(74) *Attorney, Agent, or Firm* — Morris & Kamlay LLP

(57) ABSTRACT

A system and method for the use of sensors and processors of existing, distributed systems, operating individually or in cooperation with other systems, networks or cloud-based services to enhance the detection and classification of sound events in an environment (e.g., a home), while having low computational complexity. The system and method provides functions where the most relevant features that help in discriminating sounds are extracted from an audio signal and then classified depending on whether the extracted features correspond to a sound event that should result in a communication to a user. Threshold values and other variables can be determined by training on audio signals of known sounds in defined environments, and implemented to distinguish human and pet sounds from other sounds, and compensate for variations in the magnitude of the audio signal, different sizes and reverberation characteristics of the environment, and variations in microphone responses.

17 Claims, 5 Drawing Sheets

(58) Field of Classification Search
CPC ..... A01K 45/00; A01K 1/00; A01K 27/009; A01K 31/06; G10L 17/26; G10L 15/02; G10L 15/00; G10L 15/08; G10L 15/14; G10L 15/265; G10L 25/90; G10L 25/15; G10L 25/48; G10L 25/78; G06F 17/30743; G06F 17/30017; G06F 17/30041; G06F 17/30749; G06F 17/3087; A61B 2503/40; A61B 5/08; A61B 5/7257; A61B 7/003
USPC ..... 381/56, 302, 86, 12, 14, 16, 26, 28, 57, 381/61, 321, 333, 334, 91, 92, 93, 381/94.1–94.8, 95, 97, 98, 100, 101, 102, 381/103, 118, 119, 120, 122, 73.1, 74; 704/E17.002, 231, 246, 251, E17.011, 704/E15.001, E15.002, E15.003, E15.004, 704/E15.038, E15.039, E15.04, E15.044, 704/E15.047; 700/94
See application file for complete search history.

(56) References Cited

U.S. PATENT DOCUMENTS 8,078,455 B2 12/2011 Shi et al.
8,155,329 B1 * 4/2012 Silaika ..... H03G 3/341 340/539.15
8,346,508 B2 1/2013 Kim et al.
8,825,043 B2 9/2014 Rogalski et al.
8,917,186 B1 12/2014 Grant
8,918,343 B2 12/2014 Mitchell
8,970,371 B2 3/2015 Di Marco et al.
2003/0035514 A1 2/2003 Jang et al.
2004/0189460 A1 9/2004 Heaton et al.
2005/0049877 A1 * 3/2005 Agranat ..... A01K 11/008 704/270
2005/0125403 A1 6/2005 Wakabayashi et al.
2005/0187761 A1 8/2005 Shi et al.
2006/0033625 A1 2/2006 Johnson et al.
2007/0183604 A1 8/2007 Araki et al.
2007/0256499 A1 11/2007 Pelecanos et al.
2008/0257047 A1 10/2008 Pelecanos et al.
2010/0259404 A1 10/2010 Cho et al.
2011/0054844 A1 3/2011 Han et al.
2011/0060553 A1 3/2011 Han et al.
2011/0218952 A1 9/2011 Mitchell et al.
2012/0071741 A1 * 3/2012 Moussavi ..... A61B 5/4818 600/340
2013/0262322 A1 10/2013 Kwon et al.
2014/0266669 A1 9/2014 Fadell et al.
2014/0328486 A1 * 11/2014 Gopinath ..... H04R 3/00 381/56
2015/0106095 A1 4/2015 Mitchell
2015/0112678 A1 4/2015 Binks et al.

* cited by examiner

SOUND EVENT DETECTION

BACKGROUND

As data measurement, processing and communication tools become more available, their use in practical applications becomes more desirable. As one example, data measurement, processing and communication regarding environmental conditions can have significant beneficial applications. There are a number of environmental conditions that can be of interest and subject of detection and identification at any number of desired locations. For example, it may be desirable to obtain accurate, real-time data measurement which permits detection of sounds in a particular environment such as a home or business. Further, real-time data identification of such sounds to quickly and accurately distinguish sound categories also may be desirable, such as to permit the creation and communication of a user message, such as an alert, based thereon.

Such data measurement and analysis would typically require a distribution of sensors, processors and communication elements to perform such functions quickly and accurately. However, implementing and maintaining such a distribution of sensors solely for the purpose of data measurement and distinction regarding sounds may be cost prohibitive. Further, the distribution of such devices may require implementation and maintenance of highly capable processing and communication elements at each environment to perform such functions quickly and accurately, which further becomes cost prohibitive.

BRIEF SUMMARY

According to implementations of the disclosed subject matter, a system and method is provided for the effective and efficient use of existing control and sensing devices distributed in a home, indoor environment or other environment of interest, for accurate, real-time data measurement which perm its detection and analysis of environmental data such as sound, and selectively providing a user message such as an alert in response.

An implementation of the disclosed subject matter provides for the operation of a device in a home, business or other location, such as a premises management device, to permit detection and analysis of environmental data such as sound, and selectively provide a user message such as an alert in response.

An implementation of the disclosed subject matter also provides for the operation of a microphone sensor of the device to detect sound in an area and generate an audio signal based on the detected sound.

An implementation of the disclosed subject matter also provides for the operation of a processor of the device to convert the audio signal of the sensor into low-resolution audio signal data and analyze the audio signal data at the device processor level to identify a category of the detected sound and selectively provide a communication regarding the category of the detected sound.

An implementation of the disclosed subject matter also provides for a feature extraction function to be performed by the processor to extract the low-resolution features of the audio signal that distinguish detected sounds on a frame-by-frame basis.

An implementation of the disclosed subject matters also provides for a state classification function to be performed by the processor to compare the extracted features to threshold values that distinguish sound categories to generate outputs indicating occurrences of distinguished sound categories.

An implementation of the disclosed subject matter also provides for a detection function to be performed by the processor to detect the occurrence of a sound category of interest.

An implementation of the disclosed subject matter also provides for the sound categories to include sounds associated with a human or pet within the home or environment, and sounds not associated with a human or pet within the home or environment.

An implementation of the disclosed subject matter also provides for the training on audio signals of known sounds in defined environments to determine variable and threshold values that distinguish sound categories and that compensate for variations in audio signal, environment and microphones.

An implementation of the disclosed subject matter also provides for the operation of a communication element to generate and communicate a user message such as an alert, in response to the detected occurrence of a sound category of interest.

An implementation of the disclosed subject matter also provides for the functions to be performed by the processor of each device, by a network of device processors, by remote service providers such as cloud-based or network services, or combinations thereof, to permit a use of devices with lower processing abilities.

Accordingly, implementations of the disclosed subject matter provides means for the use of sensors and processors that are found in existing, distributed systems, operating individually or in cooperation with other systems, networks or cloud-based services, to enhance the detection and classification of sound events in an environment (e.g., a home) and provide a user communication based thereon, while having low computational complexity.

Implementations of the disclosed subject matter also provide a system and method for the use of sensors and processors that are found in existing, distributed systems, operating individually or in cooperation with other systems, networks or cloud-based services to enhance the detection and classification of sound events in an environment (e.g., a home), while having low computational complexity. The system and method provides functions where the most relevant features that help in discriminating sounds are extracted from an audio signal and then classified depending on whether the extracted features correspond to a sound event that should result in a communication to a user. Threshold values and other variables can be determined by training on audio signals of known sounds in defined environments, and implemented to distinguish, for example, human and pet sounds from other sounds, and compensate for variations in the magnitude of the audio signal, different sizes and reverberation characteristics of the environment, and variations in the responses of the microphones.

BRIEF DESCRIPTION OF THE DRAWINGS

The accompanying drawings, which are included to provide a further understanding of the disclosed subject matter, are incorporated in and constitute a part of this specification. The drawings also illustrate implementations of the disclosed subject matter and together with the detailed description serve to explain the principles of the disclosed subject matter. No attempt is made to show structural details in more detail than may be necessary for a fundamental understanding of the disclosed subject matter and various ways in which it may be practiced.

DETAILED DESCRIPTION

Figure 1:
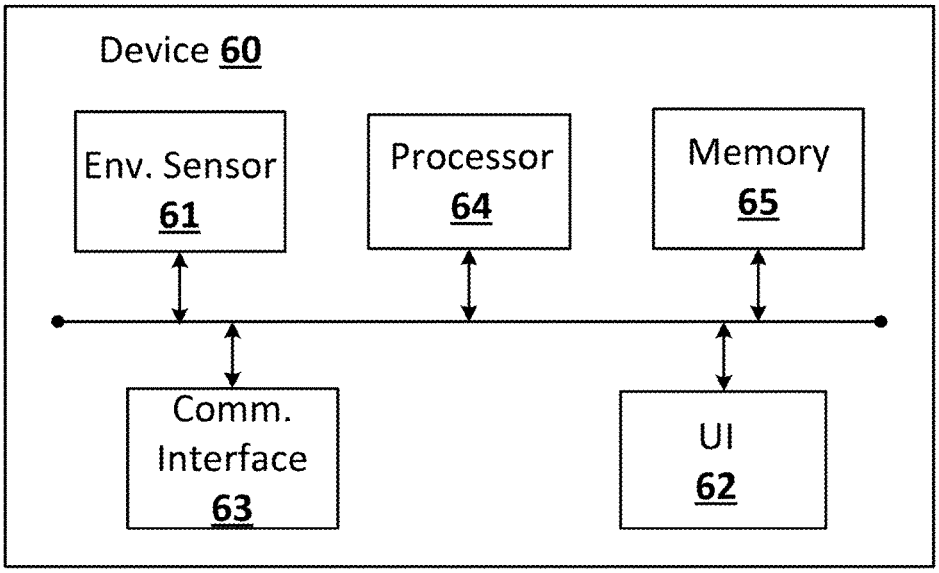
FIG. 1 shows an illustrative device for incorporating one or more of a microphone sensor, function-executing processor and communication element according to an implementation of the disclosed subject matter.

Implementations of the disclosed subject matter enable the measurement and analysis of environmental data by using sensors such as microphone sensors that are found in existing, distributed systems, for example, those found in premises management devices in homes, businesses and other locations. By measuring, processing and analyzing data from the sensors, and knowing other aspects such as location and environments of the devices containing the sensors, implementations of the disclosed subject matter detect sounds in a particular environment, distinguish sound categories, and generate and communicate a user message, such as an alert, based thereon.

Implementations disclosed herein may use one or more sensors. In general, a "sensor" may refer to any device that can obtain information about its environment. Sensors may be described by the type of information they collect. For example, sensor types as disclosed herein may include sound, motion, light, temperature, acceleration, proximity, physical orientation, location, time, entry, presence, pressure, smoke, carbon monoxide and the like. A sensor also may be described in terms of the particular physical device that obtains the environmental information. For example, an accelerometer may obtain acceleration information, and thus may be used as a general motion sensor, vibration sensor and/or acceleration sensor. A sensor also may be described in terms of the specific hardware components used to implement the sensor. For example, a sound sensor may include a microphone and a temperature sensor may include a thermistor, thermocouple, resistance temperature detector, integrated circuit temperature detector, or combinations thereof. A sensor also may be described in terms of a function or functions the sensor performs within an integrated sensor network, such as a smart home environment as disclosed herein. For example, a sensor may operate as a security sensor when it is used to determine security events such as unauthorized entry.

A sensor may operate with different functions at different times, such as where a motion sensor or microphone sensor is used to control lighting in a smart home environment when an authorized user is present, and is used to alert to unauthorized or unexpected movement or sound when no authorized user is present, or when an alarm system is in an "armed" state, or the like. In some cases, a sensor may operate as multiple sensor types sequentially or concurrently, such as where a temperature sensor is used to detect a change in temperature, as well as the presence of a person or animal. A sensor also may operate in different modes at the same or different times. For example, a sensor may be configured to operate in one mode during the day and another mode at night. As another example, a sensor may operate in different modes based upon a state of a home security system or a smart home environment, or as otherwise directed by such a system.

A sensor as disclosed herein may also include multiple sensors or sub-sensors, such as where a position sensor includes both a global positioning sensor (GPS) as well as a wireless network sensor, which provides data that can be correlated with known wireless networks to obtain location information. Multiple sensors may be arranged in a single physical housing, such as where a single device includes sound, movement, temperature, magnetic and/or other sensors. For clarity, sensors are described with respect to the particular functions they perform and/or the particular physical hardware used when such specification is necessary for understanding. Such a housing and housing contents may be referred to as a "sensor", "sensor device" or simply a "device".

One such device, a "premises management device" may include hardware and software in addition to the specific physical sensor(s) that obtain information about the environment. FIG. 1 shows an illustrative premises management device as disclosed herein. The premises management device 60 can include may include an environmental sensor 61, a user interface (UI) 62, a communication interface 63, a processor 64 and a memory 65. The environmental sensor 61 can include one or more of the sensors noted above, such as a microphone sensor or any other suitable environmental sensor that obtains a corresponding type of information about the environment in which the premises management device 60 is located. The processor 64 can receive and analyze data obtained by the sensor 61, control operations of other components of the premises management device 60 and process communication with other devices by executing instructions stored on the computer-readable memory 65. The memory 65 or another memory in the premises management device 60 can also store environmental data obtained by the sensor 61. The communication interface 63, such as a Wi-Fi or other wireless interface, Ethernet or other local network interface or the like, can allow for communication by the premises management device 60 with other devices.

The user interface (UI) 62 can provide information and/or receive input from a user of the device 60. The UI 62 can include, for example, a speaker to output an audible alarm when an event is detected by the premises management device 60. Alternatively, or in addition, the UI 62 can include a light to be activated when an event is detected by the premises management device 60. The user interface can be relatively minimal, such as a limited-output display, or it can be a full-featured interface such as a touchscreen.

Components within the premises management device 60 can transmit and receive information to and from one another via an internal bus or other mechanism as will be readily understood by one of skill in the art. One or more components can be implemented in a single physical arrangement, such as where multiple components are implemented on a single integrated circuit. Devices as disclosed herein can include other components, and/or may not include all of the illustrative components shown.

As a specific example, the premises management device 60 can include as an environmental sensor 61, a microphone sensor that obtains a corresponding type of information about the environment in which the premises management device 60 is located. An illustrative microphone sensor 61 includes any number of technical features and polar patterns with respect to detection, distinction and communication of data regarding sounds within an environment of the premises management device 60. As described in greater detail below, implementations of the disclosed subject matter are adaptable to any number of various microphone types and responses.

The microphone sensor 61 is configured to detect sounds within an environment surrounding the premises management device 60. Examples of such sounds include, but are not limited to, sounds generated by a human or pet occupancy (e.g., voices, dog barks, cat meows, footsteps, dining sounds, kitchen activity, and so forth), and sounds not generated by a human or pet occupancy (e.g., refrigerator hum, heating, ventilation and air-conditioning (hvac) noise, dishwasher noise, laundry noise, fan noise, traffic noise, airplane noise, and so forth). Implementations of the disclosed subject matter use microphone sensor(s) 61 that are found in existing, distributed systems, for example, those found in premises management devices 60 in homes, businesses and other locations, thereby eliminating the need for the installation and use of separate and/or dedicated microphone sensors.

The following implementations of the disclosed subject matter may be used as a monitoring system to detect when a sound event in a home, indoor environment or other environment of interest is generated, differentiate human and pet sounds from other sounds, and alert a user with a notification if sound of a particular category is detected. In doing so, implementations of the disclosed subject matter detects sounds in a home or other environment as a result of human or pet occupancy and ignores sounds that may be caused when a home or other environment is unoccupied. Using microphone sensor(s) 61 that are found in existing, distributed systems, and processor(s) 64 trained on signals of known sounds in defined environments, implementations of the disclosed subject matter can distinguish human and pet sounds from other sounds, and compensate for variations in the magnitude of the audio signal, different sizes and reverberation characteristics of the environment, and variations in the responses of the microphones.

To do so, the processor(s) 64 execute algorithms and/or code, separately or in combination with hardware features, to enhance the detection and classification of sound events in an environment caused by human and pet occupancy, while at the same time having low computational complexity. The algorithms perform feature extraction, classification and detection to distinguish human and pet sounds (e.g., voices, dog barks, cat meows, footsteps, dining sounds, kitchen activity, and so forth) from other sounds (e.g., refrigerator hum, heating, ventilation and air-conditioning (hvac) noise, dishwasher noise, laundry noise, fan noise, traffic noise, airplane noise, and so forth). Variables and other threshold values are provided to aid in the distinction and to compensate for variations in the magnitude of the audio signal, different sizes and reverberation characteristics of the room, and variations in the responses of the microphones.

According to an implementation of the disclosed subject matter, the sound-event detection is carried out in three stages, including a feature extraction stage, a classification stage, and a detection stage. Each stage may require low computational complexity so that it can be implemented on devices with low processing abilities. Additionally, some or all implementations of the stages can be provided remotely, such as in network or cloud-based processing if the option for streaming data to the cloud is available. Implementation of the stages, either at the processor of each device, by a network of device processors, by remote service providers such as cloud-based or network services, or combinations thereof, provides a monitoring system to detect when a sound event in a home, indoor environment or other environment of interest is generated and differentiate human and pet sounds from other sounds. In at least one implementation of the disclosed subject matter, sounds that may be caused when a home is unoccupied are ignored, and sounds caused when a home is occupied are differentiated for various alerting purposes.

Figure 2:
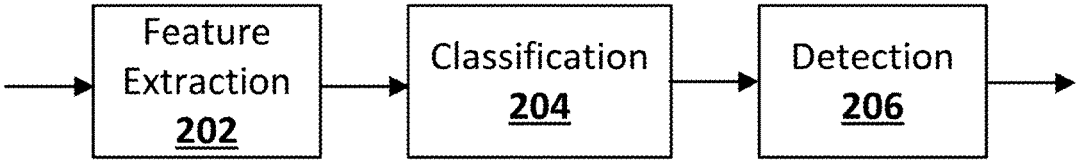
FIG. 2 is an illustrative block diagram of a sound-event detector executed by the processor according to an implementation of the disclosed subject matter.

FIG. 2 is an illustrative block diagram of a sound-event detector executed by the processor(s) 64 according to an implementation of the disclosed subject matter. As noted above, the sound-event detection is carried out in three stages, including a feature extraction stage 202, a classification stage 204, and a detection stage 206, but embodiments are not limited thereto. In the feature extraction stage 202, sound data provided by the microphone sensor 61 is received and the most relevant features that help in discriminating sounds such as human and pet occupancy sounds from other sounds, are extracted from the spectrogram of the audio signal.

Such features are targeted by filters having filter lengths, frequency ranges and minimum and maximum values configured by training data to obtain compressed, low-resolution data or feature vectors to permit analysis at a device processor level. The filter variables and classification state variables and thresholds, described in greater detail below, allow the feature extraction stage 202 and the detection stage 206 to distinguish sound categories, such as human and pet sounds (e.g., voices, dog barks, cat meows, footsteps, dining sounds, kitchen activity, and so forth) from other sounds (e.g., refrigerator hum, heating, ventilation and air-conditioning (hvac) noise, dishwasher noise, laundry noise, fan noise, traffic noise, airplane noise, and so forth), and to compensate for variations in the magnitude of the audio signal, different sizes and reverberation characteristics of the room, and variations in the responses of the microphones. However, each function may require relatively low computational effort, thus permitting the use of devices with lower processing abilities.

The feature extraction stage 202 generates feature vectors fL, fM, fH based on features extracted from the audio signal and provides the feature vectors to the classification stage 204. As noted above, the feature vectors fL, fM, fH are created as compressed, low-resolution audio signal data to permit further analysis of the audio signal data at the device processor level. The classification stage 204 executes a series of condition equations Cn using the feature vectors and generates outputs "0", "1" and "2" to distinguish sound categories. The detection stage 206 analyzes the outputs and generates a user message, such as an alert, if the outputs indicate a sound caused when a home is occupied.

Figure 3:
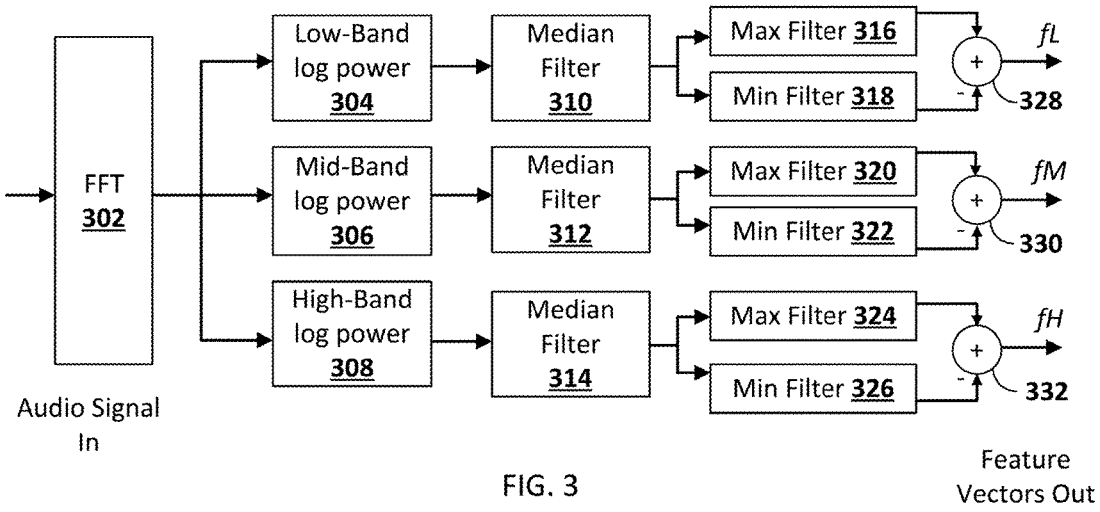
FIG. 3 is an illustrative block diagram of a feature extraction function of the sound-event detector according to an implementation of the disclosed subject matter.

FIG. 3 is an illustrative block diagram of a feature extraction function of the sound-event detector according to an implementation of the disclosed subject matter. The feature extraction stage 202 includes a Fast Fourier Transform (FFT) element 302 to receive an audio signal captured by the microphone sensor 61 and perform a frequency domain conversion. A low-band, log-power band splitter 304, a mid-band, log-power band splitter 306, and a high-band, log-power band splitter 308, split the converted signal into three bands on a frame-by-frame basis and obtains the energy of the three bands. The resulting bands are further filtered by the median filters 310, 312, 314 to filter the length of each split band, and a range of the split bands is computed as the difference between an output of maximum filters 316, 320, 324 and minimum filters 318, 322, 326 at summers 328, 330, 332 to create feature vectors fL, fM, fH, respectively.

Specifically, the feature extraction stage 202 is configured to receive an audio signal captured by the microphone sensor 61 and extract the Fast Fourier Transform 302 from a T millisecond (e.g., T=32 milliseconds) sliding window of audio data, with some overlap (e.g., 25% overlap) between windows. In one example, where a frame is 22 milliseconds in length, a frame shift of 24 milliseconds is performed, resulting in a frame of 32 milliseconds. In this case, the FFT coefficient output is 112 samples obtained at a 16 kHz sampling frequency.

The FFT coefficient output is then split into three bands on a frame-by-frame basis and the log power in the lower frequency bands, middle frequency bands, and upper frequency bands is extracted from the FFT coefficient output using a low-band, log-power band splitter 304, a mid-band, log-power band splitter 306, and a high-band, log-power band splitter 308. In one example, the lower band can be 0.5-1.5 kHz; the middle band can be 1.5-4 kHz; and the upper band can be 3.5-8 kHz. The resulting time-series, log-power in each of the bands is then passed through corresponding median filters 310, 312, 314 of length K (e.g., K=4 frames).

Finally, the median filter outputs are then passed through corresponding maximum filters 316, 320, 324 and minimum filters 318, 322, 326 of length L (e.g., L=30 samples) to compute a maximum of the split bands and a minimum of the split bands, respectively. Summers 328, 330, 332 compute a range of the split bands by subtracting the output of the minimum filters from the maximum filters, thereby creating feature vectors fL, fM, fH, respectively. That is, the difference between the maximum filter 316, 320, 324 outputs and minimum filter 318, 322, 326 outputs are used as feature vector inputs to the classification stage 204.

In the classification stage 204, a classifier may be used to classify whether the extracted feature vectors of a certain window correspond to a sound event that should result in a notification. For example, a classifier for the classification stage 204 may output one of three values, i.e., "0", "1" and "2", where an output "0" is provided when the feature vectors correspond to a sound event that does not require notification, an output "1" is provided when the feature vectors correspond to a sound event that may require notification, but more evidence may be needed, and an output "2" is provided when the feature vectors correspond to a sound event that requires notification. The approach can be realized using a 3-state classifier as shown in the state diagram in FIG. 4, which shows an illustrative state diagram of a classification function of the sound-event detector according to an implementation of the disclosed subject matter.

The output of the classification stage 204 for a given frame corresponds to the state of the classifier given the feature vectors for that frame. On a frame-by-frame basis, feature vectors are received from the feature extraction stage 202 and used in conditional equations to move between states of the classification stage 204 and provide outputs of "0", "1" or "2". In one implementation in which only the low- and mid-band feature vectors fL, and fM are shown, the conditions C1, C2, C3, C4, and C5 are defined as in the following Equations 1, 2, 3, 4 and 5 and are dependent upon thresholds M1, M2, Th1, . . . Th8.

$$C1=[(fL>Th1-M1)\wedge(fM>Th2)]\vee[(fL>Th1)\wedge(fM>Th2-M1)] \quad \text{Equation (1)}$$

$$C2=(fL<Th3)\wedge(fM<Th4) \quad \text{Equation (2)}$$

$$C3=[(fL>Th5)\wedge(fM>Th6-M2)]\vee[(fL>Th5-M2)\wedge(fM>Th6)] \quad \text{Equation (3)}$$

$$C4=[(fL>Th5)\wedge(fM>Th6-M2)]\vee[(fL>Th5-M2)\wedge(fM>Th6)] \quad \text{Equation (4)}$$

$$C5=(fL<Th7)\wedge(fM<Th8) \quad \text{Equation (5)}$$

Thresholds M1, M2, Th1, . . . Th8 are positive real values, for which Th1>M1, Th2>M1, Th5>M2, and Th6>M2. These thresholds can be values configured by training data to distinguish human and pet sounds (e.g., voices, dog barks, cat meows, footsteps, dining sounds, kitchen activity, and so forth) from other sounds (e.g., refrigerator hum, heating, ventilation and air-conditioning (hvac) noise, dishwasher noise, laundry noise, fan noise, traffic noise, airplane noise, and so forth). Such values can further compensate for variations in the magnitude of the audio signal, different sizes and reverberation characteristics of the room, and variations in the responses of the microphones. Although only the low and mid band feature vectors fL and fM are shown in FIG. 4, similar conditions Cn can be defined for inclusion of the high band feature vector fH and any combination of feature vectors fL, fM, fH.

One way to optimize the variables and threshold values is by training on labeled audio signal data obtained from examples of human and pet sounds and other sounds in typical home and other environments. By training on audio signals of known sounds in defined environments, threshold values and other variables can be determined and implemented to quickly and accurately distinguish human and pet sounds from other sounds and compensate for variations in the magnitude of the audio signal, different sizes and reverberation characteristics of the room, and variations in the responses of the microphones. Such values can be manually set by a user or automatically provided to the device at the time of manufacture and/or updated at any time thereafter using, for example, network connections.

Figure 4:
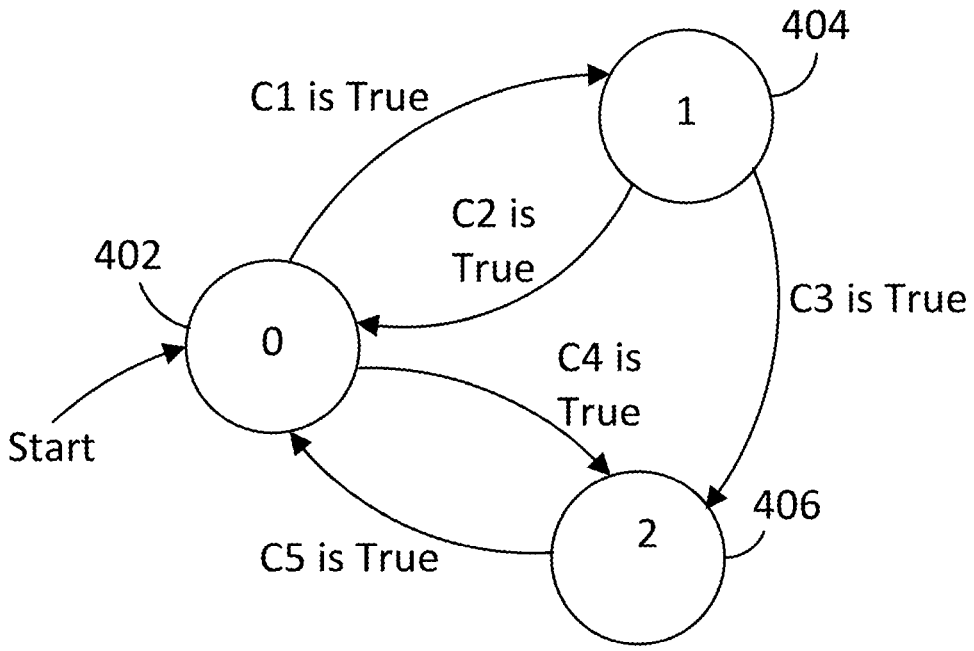
FIG. 4 is an illustrative state diagram of a classification function of the sound-event detector according to an implementation of the disclosed subject matter.

The state diagram of FIG. 4 includes three states 402, 404, 406, but is not limited thereto. At start, the device is at state 402, associated with the detection of no sound. On a frame-by-frame basis, feature vectors are received from the feature extraction stage 202 and processed using Equations (1)-(5) to move between states of the classification stage 204 and provide outputs of "0", "1" or "2" to the detection stage 206. For each frame, values of C1-C5 are determined, and a state of the classification stage 204 is determined.

Where C1 of Equation (1) is "True", the device moves to state 404, associated with the detection of sound but insufficient to move to state 406, and a "1" is output to the detection stage 206. If in the next frame, C1 remains "True", the device remains at state 404, and a "1" is output to the detection stage 206.

If in the next frame, C2 is "True", the device moves to state 402, associated with the detection of no sound, and a "0" is output to the detection stage 206. If in the next frame, C2 remains "True", the device remains at state 402, and a "0" is output to the detection stage 206.

If in the next frame, C3 or C4 is "True", the device moves to state 406, associated with the detection of sound, and a "2" is output to the detection stage 206. If in the next frame, C3 or C4 remain "True", the device remains at state 406, and a "2" is output to the detection stage 206.

If in the next frame, C5 is "True", the device moves to state 402, associated with the detection of no sound, and a "0" is output to the detection stage 206. If in the next frame, C5 remains "True", the device remains at state 402, and a "0" is output to the detection stage 206.

In the example, state 402 denotes a classification stage 204 output of "0" and occurs at startup or when C2 or C5 is "True". An output "0" is provided when the feature vectors correspond to a sound event that does not require notification. In this example, such a sound event includes sounds that are not generated by a human or pet occupancy (e.g., refrigerator hum, heating, ventilation and air-conditioning (hvac) noise, dishwasher noise, laundry noise, fan noise, traffic noise, airplane noise, and so forth). The state 404 denotes a classification stage 204 output of "1" and occurs when C1 is true. An output "1" is provided when the feature vectors correspond to a sound event that may require notification, but more evidence may be needed. Finally, the state 406 denotes a classification stage 204 output of "2" and occurs when C3 or C4 is "True". An output "2" is provided when the feature vectors correspond to a sound event that requires notification. In this example, such a sound event includes sounds generated by a human or pet occupancy (e.g., voices, dog barks, cat meows, footsteps, dining sounds, kitchen activity, and so forth).

Other classifiers may also be used to classify the feature vectors. The use of a particular classifier may depend on one or more factors such as processing abilities of the processor, available memory, amount of data available to train the classifier, and complexity of the feature space. Some examples of classifiers that may be used include but are not limited to random forest, linear SVM, naive bayes, and Gaussian mixture models. The low computational complexity of the extraction and classification features makes them feasible for implementation on devices with lower processing abilities. During classification, the designed features facilitate more robustness towards different room sizes and reverberation, varying distances between source and microphone, and variations in microphone responses.

The detection stage 206 analyzes the outputs and generates a user message, such as an alert, if the outputs indicate a sound caused when a home is occupied. The detection stage 206 receives outputs "0", "1" and "2" of the classification stage 204 which distinguishes sound categories, and generates and communicates a user message, such as an alert, based thereon.

In one implementation of the disclosed subject matter, the detection stage 206 is configured to generate a detector output D="1" resulting in an alert when a human or pet occupancy sound is detected, and generate a detector output D="0" resulting in no alert at other times. In one implementation, upon receiving an output "2" of the classification stage 204, the detection stage 206 can immediately generate an alert without further measurements (e.g., detector output D="1"). In another implementation, the detection stage 206 can await receipt of a set N of classification stage 204 outputs, and evaluate the group for the presence of "0"s, "1"s and "2"s. Where at least one "2" is received in the set N, the alert can be generated (e.g., detector output D="1"). Where the set N consists of only "0"s, no alert can be generated (e.g., detector output D="0"). Where the set N consists of "0"s and "1"s but no "2"s, no alert can be generated (e.g., detector output D="0") or the alert can be selectively generated (e.g., detector output D="1") when the percentage of "1"s (average) exceeds a threshold value or in the case of a skewed distribution, a large percentage of "1"s are received near the end of the period of the set N.

Figure 5:
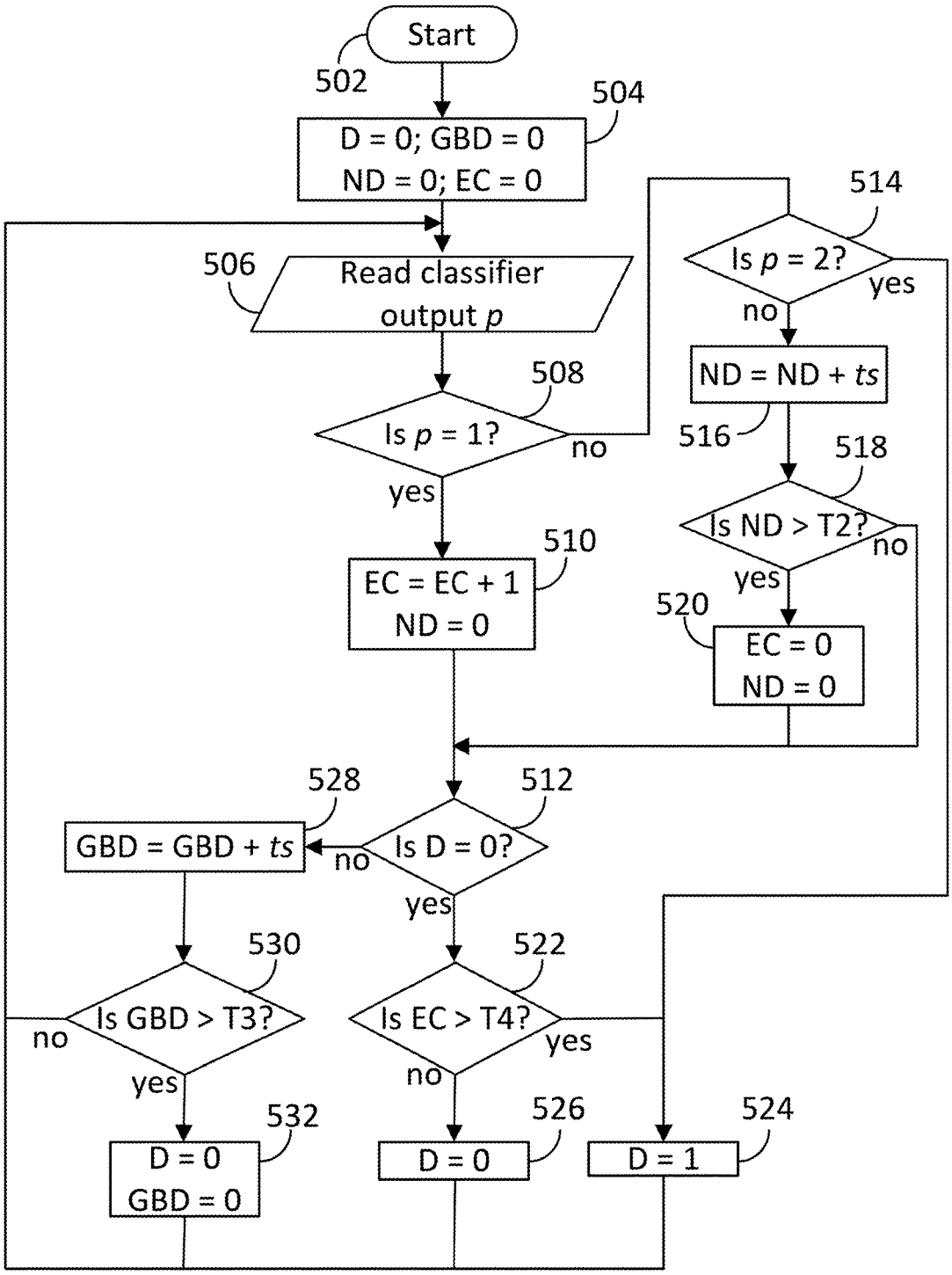
FIG. 5 is an illustrative flow chart of a detection function of the sound-event detector according to an implementation of the disclosed subject matter.
Figure 6:
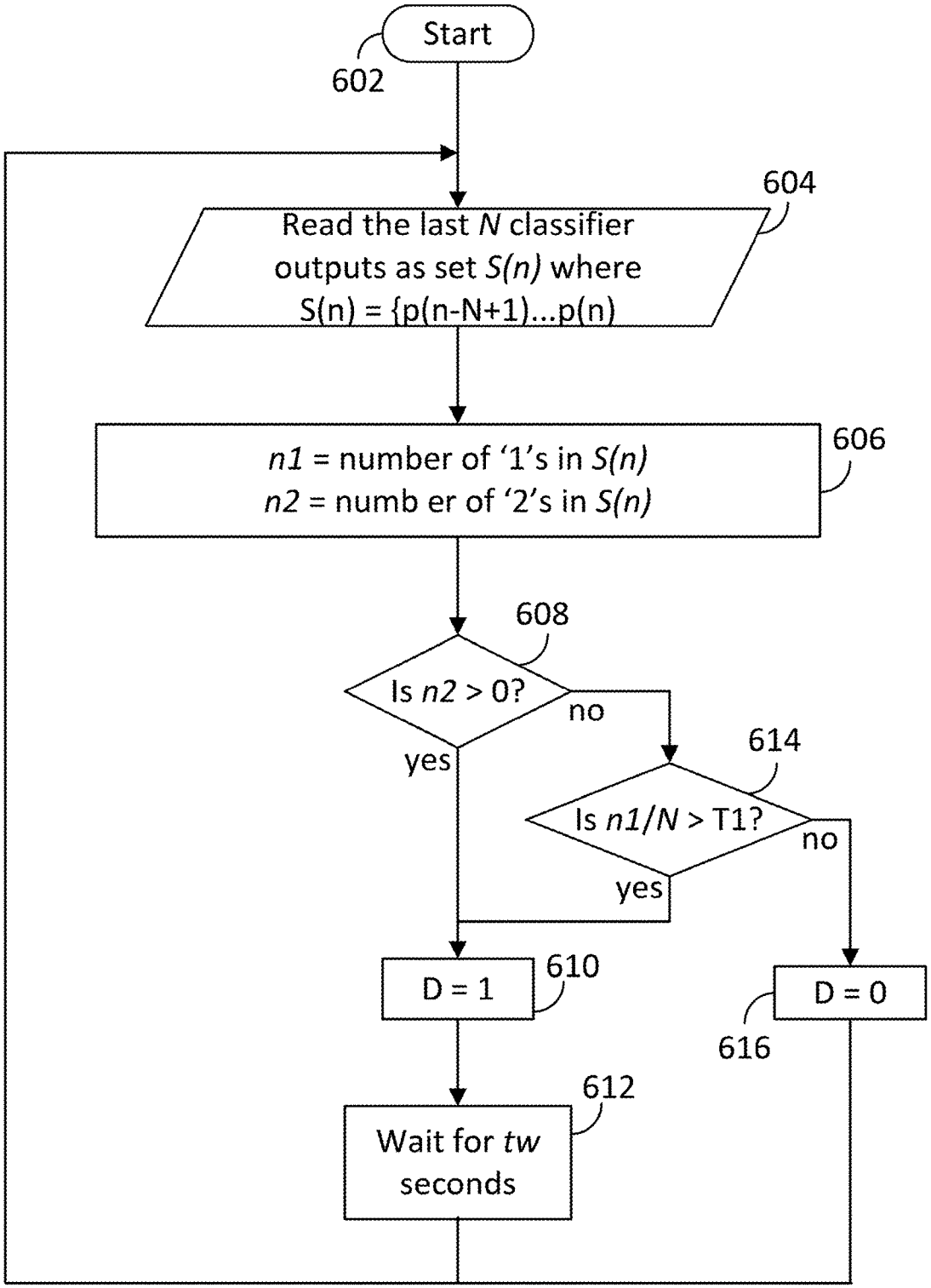
FIG. 6 is an illustrative flow chart of another detection function of the sound-event detector according to an implementation of the disclosed subject matter.

Two examples of approaches for implementing the detection stage 206 are shown in FIG. 5 and FIG. 6. FIG. 5 is an illustrative flow chart of a detection function of the sound-event detector and FIG. 6 is an illustrative flow chart of another detection function of the sound-event detector according to implementations of the disclosed subject matter. In FIG. 5, the detection stage receives and analyzes the classification stage 204 output at every frame and generates a detection stage output D based thereon, while in FIG. 6 the detection stage receives a sliding window of N classification stage 204 outputs and awaits receipt of the entire set N before analysis and generation of a detection stage output D. Accordingly, one advantage of a detection stage as illustrated in FIG. 5 is lower latency, as it does not need to wait for the complete set of N outputs as in the detection stage of FIG. 6 to make a decision, but may require greater processing ability.

The detection function of FIG. 5 starts at 502, and sets the detection stage output D to "0", the gap between detections GBD timer (in seconds) to "0", the no-event duration ND timer (in seconds) to "0", and the event counter EC (in samples) to "0" at 504. At data input 506, the function reads the classification stage 204 output p (e.g., outputs "0", "1" and "2") and determines if the output is "1" at 508.

If the output is "1" at 508, the event counter EC is incremented by "1" and the no-event duration ND timer is set to "0" at 510, and the function determines if a detection stage output D is "0" at 512. The event counter EC is increased in this manner until exceeding a value of T4 with an example typical value of T4 being 15 samples, and generating an alert based on receipt of a large percentage of "1"s. If the output is not "1" at 508, the function determines if the output is "2" at 514.

If the output is "2" at 514, the detection stage 206 output D is set to "1" at 524, generating an alert based on receipt of a single "2", and the function returns to 506. If the output is not "2" at 514, the no-event duration ND timer is incremented by ts at 516, where ts represents a sampling time in seconds. The no-event duration ND timer is increased in this manner until exceeding a value of T2 with an example typical value of T2 being 10 seconds, acknowledging that a long period of no sound has occurred. The function then determines if the no-event duration ND timer is greater than T2 at 518 and if so, the event counter EC and the no-event duration ND timer are set to "0" at 520, and the function determines if a detection stage output D is "0" at 512. If the function determines that the no-event duration ND timer is not greater than T2 at 518, the function determines if a detection stage 206 output D is "0" at 512.

If the function determines at 512 that the detection stage 206 output D is "0", the function determines if the event counter EC is greater than T4 at 522 and if so, the detection stage 206 output D is set to "1" at 524 and the function returns to 506. If function determines that the event counter EC is not greater than T4 at 522, the detection stage 206 output D is set to "0" at 526 and the function returns to 506.

If the function determines at 512 that the detection stage 206 output D is not "0", the gap between detections GBD timer is incremented by ts at 528. The gap between detections GBD timer is increased in this manner until exceeding a value of T3 with an example typical value of T3 being 30 seconds, acknowledging that a long period between sounds has occurred. The function then determines if the gap between detections GBD timer is greater than T3 at 530 and if not, returns to 506. If the gap between detections GBD timer is greater than T3 at 530, the detection stage 206 output D and gap between detections GBD timer are set to "0" at 532 and the function returns to 506.

In FIG. 5, typical values of T2, T3 and T4 are 10 seconds, 30 seconds, and 15 samples, respectively, but are not limited thereto. In FIG. 5, the detection stage 206 receives and analyzes the classification stage 204 output at every frame and generates a detection stage 206 output D based thereon. Upon receiving an output "2" of the classification stage 204, the alert can be immediately generated (e.g., detector output D=1). In any case, the detection stage 206 of FIG. 5 does not need to wait for the complete set of N outputs as in the detection stage 206 of FIG. 6 to make a decision.

In FIG. 6, the detection stage receives a sliding window of N classification stage 204 outputs and waits for most or all of the set of N outputs to make a decision. The detection function of FIG. 6 starts at 602, and reads the last set of N classification stage 204 outputs as set S(n) at 604 where, $$S(n)=\{p(n-N+1), \ldots, p(n)\}$$

The value n1 is set to the number of "1"s in S(n), and the value n2 is set to the number of "2"s in S(n) at 606. The function then determines if n2 is greater than "0" at 608 and if so, the detection stage 206 output D is set to "1" at 610 and the function waits for a period of tw seconds at 612 before returning to 604, where tw represents a waiting period in seconds.

If n2 is not greater than "0" at 608, the function determines if n1 divided by N is greater than T1 and if so, the detection stage 206 output D is set to "1" at 610 and the function waits for a period of tw seconds at 612 before returning to 604. If n1 divided by N is not greater than T1, the detection stage 206 output D is set to "0" at 616 and the function returns to 604. In FIG. 6, a typical value of T1 is 0.5, but is not limited thereto.

Upon a detector output D=1, the processor 64 can direct the creation of a message or alert, and control the communication interface 63 to send the user message or alert to a user or group of users or other addresses via phone message, email message, text message or other similar manner.

As noted above, each premises management device 60 can include the processor 64 to receive and analyze data obtained by the sensor 61, control operations of other components of the premises management device 60, and process communication with other devices and network or cloud-based levels. The processor 64 may execute instructions stored on the computer-readable memory 65, and the communication interface 63 allows for communication with other devices and uploading data and sharing processing with network or cloud-based levels.

Further, a number of techniques can be used to identify malfunctioning microphone sensors such as detection of unexpected excessive or minimal measurement values, erratic or otherwise unusable measurement values and/or measurement values which fail to correlate with one or more other measurement values. Data of such malfunctioning microphone sensors can be excluded from the operation of the device.

In some implementations, the premises management device 60 uses encryption processes to ensure privacy, anonymity and security of data. Data stored in the device's memory as well as data transmitted to other devices can be encrypted or otherwise secured. Additionally, the user can set the device profile for data purging, local processing only (versus cloud processing) and to otherwise limit the amount and kind of information that is measured, stored and shared with other devices. The user can also be provided with an opt-in mechanism by which they can voluntarily set the amount and type of information that is measured, stored and communicated. Users may also opt-out of such a system at any time.

Devices as disclosed herein may operate within a communication network, such as a conventional wireless network, and/or a sensor-specific network through which sensors may communicate with one another and/or with dedicated other devices. In some configurations one or more sensors may provide information to one or more other sensors, to a central controller, or to any other device capable of communicating on a network with the one or more sensors. A central controller may be general- or special-purpose. For example, one type of central controller is a home automation network that collects and analyzes data from one or more sensors within the home. Another example of a central controller is a special-purpose controller that is dedicated to a subset of functions, such as a security controller that collects and analyzes sensor data primarily or exclusively as it relates to various security considerations for a location. A central controller may be located locally with respect to the sensors with which it communicates and from which it obtains sensor data, such as in the case where it is positioned within a home that includes a home automation and/or sensor network.

Figure 7:
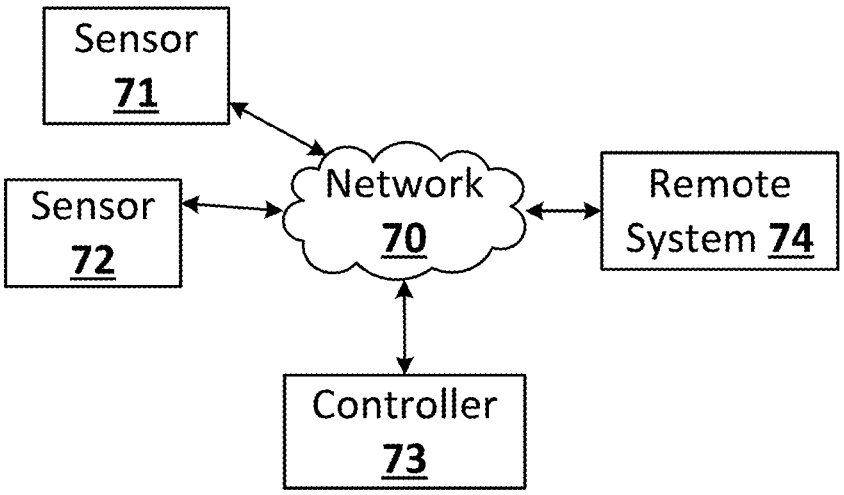
FIG. 7 shows an illustrative device network as disclosed herein, which may be implemented over any suitable wired and/or wireless communication network.

Alternatively or in addition, a central controller as disclosed herein may be remote from the sensors, such as where the central controller is implemented as a cloud-based system that communicates with multiple sensors, which may be located at multiple locations and may be local or remote with respect to one another. FIG. 7 shows an illustrative sensor network as disclosed herein, which may be implemented over any suitable wired and/or wireless communication networks.

In the network of FIG. 7, one or more sensors 71, 72 may communicate via a local network 70, such as a Wi-Fi or other suitable network, with each other and/or with a controller 73. The controller may be a general- or special-purpose computer which may, for example, receive, aggregate, and/or analyze environmental information received from the sensors 71, 72. The sensors 71, 72 and the controller 73 may be located locally to one another, such as within a single dwelling, office space, building, room, or the like, or they may be remote from each other, such as where the controller 73 is implemented in a remote system 74 such as a cloud-based reporting and/or analysis system. Alternatively or in addition, sensors may communicate directly with a remote system 74. The remote system 74 may, for example, aggregate data from multiple locations, provide instruction, software updates, and/or aggregated data to a controller 73 and/or sensors 71, 72.

The sensor network shown in FIG. 7 may be an example of a smart-home environment which may include a structure, a house, office building, garage, mobile home, or the like. The devices of the smart home environment, such as the sensors 71, 72, the controller 73, and the network 70 may be integrated into a smart-home environment that does not include an entire structure, such as an apartment, condominium, or office space.

The smart home environment can control and/or be coupled to devices outside of the structure. For example, one or more of the sensors 71, 72 may be located outside the structure, for example, at one or more distances from the structure (e.g., sensors 71, 72 may be disposed outside the structure), at points along a land perimeter on which the structure is located, and the like. One or more of the devices in the smart home environment need not physically be within the structure. For example, the controller 73 which may receive input from the sensors 71, 72 may be located outside of the structure.

The structure of the smart-home environment may include a plurality of rooms, separated at least partly from each other via walls. The walls can include interior walls or exterior walls. Each room can further include a floor and a ceiling. Devices of the smart-home environment, such as the sensors 71, 72, may be mounted on, integrated with and/or supported by a wall, floor, or ceiling of the structure.

The smart-home environment including the sensor network shown in FIG. 7 may include a plurality of devices, including intelligent, multi-sensing, network-connected devices that can integrate seamlessly with each other and/or with a central server or a cloud-based computing system (e.g., controller 73 and/or remote system 74) to provide home-security and smart-home features. The smart-home environment may include one or more intelligent, multi-sensing, network-connected thermostats (e.g., "smart thermostats"), one or more intelligent, network-connected, multi-sensing hazard detection units (e.g., "smart hazard detectors"), and one or more intelligent, multi-sensing, network-connected entryway interface devices (e.g., "smart doorbells"). The smart hazard detectors, smart thermostats, and smart doorbells may be the sensors 71, 72 shown in FIG. 7.

A user can interact with one or more of the network-connected smart devices (e.g., via the network 70). For example, a user can communicate with one or more of the network-connected smart devices using a computer (e.g., a desktop computer, laptop computer, tablet, or the like) or other portable electronic device (e.g., a smartphone, a tablet, a key FOB, and the like). A webpage or application can be configured to receive communications from the user and control the one or more of the network-connected smart devices based on the communications and/or to present information about the device's operation to the user. For example, the user can view, arm, or disarm, the security system of the home.

One or more users can control one or more of the network-connected smart devices in the smart-home environment using a network-connected computer or portable electronic device. In some examples, some or all of the users (e.g., individuals who live in the home) can register their mobile device and/or key FOBs with the smart-home environment (e.g., with the controller 73). Such registration can be made at a central server (e.g., the controller 73 and/or the remote system 74) to authenticate the user and/or the electronic device as being associated with the smart-home environment, and to provide permission to the user to use the electronic device to control the network-connected smart devices and the security system of the smart-home environment. A user can use their registered electronic device to remotely control the network-connected smart devices and security system of the smart-home environment, such as when the occupant is at work or on vacation. The user may also use their registered electronic device to control the network-connected smart devices when the user is located inside the smart-home environment.

A smart-home environment may include communication with devices outside of the smart-home environment but within a proximate geographical range of the home. For example, the smart-home environment may include an outdoor lighting system (not shown) that communicates information through the communication network 70 or directly to a central server or cloud-based computing system (e.g., controller 73 and/or remote system 74) regarding detected movement and/or presence of people, animals, and any other objects and receives back commands for controlling the lighting accordingly.

Various implementations of the presently disclosed subject matter may include or be embodied in the form of computer-implemented processes and apparatuses for practicing those processes. Implementations also may be embodied in the form of a computer program product having computer program code containing instructions embodied in non-transitory and/or tangible media, such as hard drives, USB (universal serial bus) drives, or any other machine readable storage medium, such that when the computer program code is loaded into and executed by a computer, the computer becomes an apparatus for practicing implementations of the disclosed subject matter. When implemented on a general-purpose microprocessor, the computer program code may configure the microprocessor to become a special-purpose device, such as by creation of specific logic circuits as specified by the instructions.

Implementations can utilize hardware that may include a processor, such as a general purpose microprocessor and/or an Application Specific Integrated Circuit (ASIC) that embodies all or part of the techniques according to the disclosed subject matter in hardware and/or firmware. The processor may be coupled to memory, such as RAM, ROM, flash memory, a hard disk or any other device capable of storing electronic information. The memory may store instructions adapted to be executed by the processor to perform the techniques according to the disclosed subject matter.

The foregoing description, for purpose of explanation, has been described with reference to specific implementations. However, the illustrative discussions above are not intended to be exhaustive or to limit the disclosed subject matter to the precise forms disclosed. Many modifications and variations are possible in view of the above teachings. The implementations were chosen and described in order to explain the principles of the disclosed subject matter and practical applications, to thereby enable others skilled in the art to utilize those implementations as well as other implementations with various modifications as may be suited to the particular use contemplated.

The invention claimed is:

1. An environmental data monitoring and reporting system, comprising:

a device sensor that detects sound in an area and generates an audio signal based on the detected sound;

a device processor communicatively coupled to the device sensor, wherein the device processor is configured to convert the audio signal received from the device sensor into low-resolution audio signal data comprising a plurality of low-resolution feature vectors representative of the detected sound, and to analyze the low-resolution audio signal data, at the device processor level, to identify the detected sound as one of either a sound related to area human or pet occupancy, or a sound generated by a source other than the area human or pet occupancy, and provide a communication regarding the detected area human or pet occupancy-related sound; and a device communication interface communicatively coupled to the device processor, wherein the device communication interface is configured to send the communication regarding the detected area human or pet occupancy-related sound, wherein the device sensor, device processor and device communication interface are integrated into a single premises management device, and wherein the device processor is configured to:

implement a Fast Fourier Transform element to perform a frequency domain conversion of the audio signal;

implement a plurality of bandwidth filters, a plurality of median filters, a plurality of range filters, and a plurality of summers, to extract the low-resolution feature vectors that distinguish the detected sound;

implement a state classifier element to determine state transition conditions by comparing the low-resolution feature vectors to threshold values that distinguish sound categories and generate outputs indicating occurrences of the distinguished sound categories; and implement a detector element to detect an occurrence of a sound category indicating the area human or pet occupancy and generate a user message in response.

2. The environmental data monitoring and reporting system of claim 1, further comprising the Fast Fourier Transform element, implemented by the device processor, to perform the frequency domain conversion of the audio signal, on a frame-by-frame basis.

3. The environmental data monitoring and reporting system of claim 1, further comprising:

the plurality of bandwidth filters, implemented by the device processor, to divide the bands of the frequency domain conversion;

the plurality of median filters, implemented by the device processor, to median filter the divided bands;

the plurality of range filters, implemented by the device processor, to filter a range of sample lengths; and the plurality of summers, implemented by the device processor, to subtract a minimum sample range value from a maximum sample range value to calculate the plurality of low-resolution feature vectors that distinguish the detected sound, on a frame-by-frame basis.

4. The environmental data monitoring and reporting system of claim 1, further comprising:

the state classifier element, implemented by the device processor, to determine the state transition conditions by comparing the plurality of low-resolution feature vectors to threshold values and generate the outputs indicating the occurrences of distinguished sound categories, on a frame-by-frame basis.

5. The environmental data monitoring and reporting system of claim 4, wherein the device processor is configured to train on low-resolution audio signal data of known sound categories in defined areas to determine the threshold values that distinguish the sound categories and that compensate for low-resolution audio signal data, area and sensor variations.

6. The environmental data monitoring and reporting system of claim 1, further comprising:

the detector element, implemented by the device processor, to detect the occurrence of the sound category indicating the area human or pet occupancy; and the device communication interface, implemented by the device processor, to communicate the user message in response to the detected occurrence of the sound category indicating the area human or pet occupancy.

7. The environmental data monitoring and reporting system of claim 6, wherein the detector element is configured to analyze each output indicating the occurrence of the sound category as received to detect an output denoting the occurrence of the sound category indicating the area human or pet occupancy.

8. The environmental data monitoring and reporting system of claim 6, wherein the detector element is configured to analyze a set of the outputs indicating the occurrences of the sound categories to detect a first output of the set denoting the occurrence of the sound category indicating the area human or pet occupancy.

9. The environmental data monitoring and reporting system of claim 6, wherein the detector element is configured to statistically analyze a set of the outputs indicating the occurrences of the distinguished sound categories to detect a likelihood of an occurrence of the sound category indicating the area human or pet occupancy.

10. An environmental data monitoring and reporting system, comprising:

a device sensor, comprising a microphone, that detects a condition comprising one or more sounds in an area and generates an audio signal based on the detected condition;

a device processor communicatively coupled to the device sensor, wherein the device processor is configured to receive the audio signal and convert the audio signal received from the device sensor into low-resolution signal data comprising a plurality of low-resolution feature vectors representative of the one or more sounds in the area and to analyze the low-resolution signal data, at the device processor level, by:

implementing a Fast Fourier Transform element, a plurality of bandwidth filters, a plurality of median filters, a plurality of range filters, and a plurality of summers, to perform a frequency domain conversion of the audio signal and extract the low-resolution feature vectors that distinguish detected conditions, implementing a state classifier element to compare the low-resolution feature vectors to threshold values that distinguish condition categories, generating outputs indicating occurrences of the distinguished condition categories, and implementing a detector element to detect one of the distinguished condition categories, which represents one of either a sound related to an area human or pet occupancy, or a sound generated by a source other than the area human or pet occupancy, and generate a user message in response; and a device communication interface communicatively coupled to the device processor, wherein the device communication interface is configured to send the user message regarding the detected area human or pet occupancy-related condition, wherein the device sensor, device processor and device communication interface are integrated into a single premises management device.

11. The environmental data monitoring and reporting system of claim 10, further comprising:

the Fast Fourier Transform element, implemented by the device processor, to perform the frequency domain conversion of the audio signal;

the plurality of bandwidth filters, implemented by the device processor, to divide the bands of the frequency domain conversion;

the plurality of median filters, implemented by the device processor, to median filter the divided bands;

the plurality of range filters, implemented by the device processor, to filter a range of sample lengths; and the plurality of summers, implemented by the device processor, to subtract a minimum sample range value from a maximum sample range value to calculate the plurality of low-resolution feature vectors that distinguish the detected conditions.

12. The environmental data monitoring and reporting system of claim 10, further comprising:

the state classifier element, implemented by the device processor, to compare the plurality of low-resolution feature vectors to the threshold values and generate the outputs indicating the occurrences of the distinguished condition categories.

13. The environmental data monitoring and reporting system of claim 12, wherein the device processor is configured to train on low-resolution signal data of known condition categories in defined areas to determine the threshold values that distinguish the condition categories and that compensate for signal data, area and sensor variations.

14. The environmental data monitoring and reporting system of claim 10, further comprising:

the detector element, implemented by the device processor, to detect the occurrence of the condition category indicating the area human or pet occupancy; and the device communication interface, implemented by the device processor, to communicate the user message in response to the detected occurrence of the condition category indicating the area human or pet occupancy.

15. A method for controlling an environmental data monitoring and reporting system, comprising:

detecting sound in an area and generating an audio signal based on the detected sound;

converting the audio signal into low-resolution audio signal data comprising a plurality of low-resolution feature vectors representative of the sound in the area, and analyzing the low-resolution audio signal data, at a device processor level, to identify the detected sound as one of either a sound related to area human or pet occupancy, or a sound generated by a source other than the area human or pet occupancy, and provide a communication regarding the detected area human or pet occupancy-related sound; and sending the communication regarding the detected area human or pet occupancy-related sound, wherein the detecting step, converting-step, analyzing step and sending are performed by a single premises management device, wherein the converting comprises performing a frequency domain conversion of the audio signal using a Fast Fourier Transform and extracting the low-resolution feature vectors that distinguish detected sounds, where the extracting is performed using a plurality of bandwidth filters, a plurality of median filters, a plurality of range filters, and a plurality of summers, to extract the low-resolution feature vectors, and the analyzing step comprises determining state transition conditions by comparing the low-resolution feature vectors to threshold values that distinguish sound categories and generating outputs indicating occurrences of the distinguished sound categories.

16. The method of claim 15, wherein the analyzing step further comprises detecting the occurrence of the sound category indicating an area human or pet occupancy and generating a user message in response.

17. The method of claim 15, further comprising training on low-resolution audio signal data of known sound categories in defined areas to determine the threshold values that distinguish the sound categories and that compensate for audio signal, area and sensor variations.

* * * * *